US006445377B1

(12) United States Patent
Shimomura

(10) Patent No.: US 6,445,377 B1
(45) **Date of Patent: *Sep. 3, 2002**

(54) MULTI-WAY INPUT DEVICE

(75) Inventor: Hisato Shimomura, Miyagi-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/333,276

(22) Filed: Jun. 14, 1999

(30) Foreign Application Priority Data

Oct. 5, 1998 (JP) ..... 10-282393

(51) Int. Cl.[7] ..... G09G 5/08

(52) U.S. Cl. ..... 345/161

(58) Field of Search ..... 345/161, 156, 345/160, 159, 163–167, 169

(56) References Cited

U.S. PATENT DOCUMENTS

| | | | | |
|---|---|---|---|---|
| 5,229,742 A | | 7/1993 | Miyamoto et al. | |
| 5,491,497 A | * | 2/1996 | Suzuki | 345/157 |
| 6,150,919 A | * | 11/2000 | Shimomura | 338/128 |
| 6,198,471 B1 | * | 3/2001 | Cook | 345/161 |

FOREIGN PATENT DOCUMENTS

JP Hei 4-36618 7/1918

* cited by examiner

*Primary Examiner*—Richard Hjerpe
*Assistant Examiner*—Ronald Laneau
(74) *Attorney, Agent, or Firm*—Brinks Hofer Gilson & Lione

(57) ABSTRACT

In the multi-way input device, an operating shaft is formed with a cylindrical potion which receives a return spring therein, and pivot shaft portions of a convex shape are formed on part of an outer wall of the cylindrical portion, the pivot shaft portions being engaged by snap-fitting with engaging portions of a concave shape formed in side walls of a second interlocking member which define a slot. The return spring is received in a receptacle space formed within the cylindrical portion.

9 Claims, 8 Drawing Sheets

MULTI-WAY INPUT DEVICE

BACKGROUND OF THE INVENTION

1. Field of the Invention

The present invention relates to a multi-way input device capable of operating a plurality of electric components by operation of an operating shaft.

2. Description of the Related Art

A conventional multi-way input device is constructed as in FIGS. 11 to 13, in which a first interlocking member 31 curved in an arch shape is disposed in the interior of a frame 30, the frame 30 being formed in the shape of a box having side plates and which is open on its lower side. The first interlocking member 31 has mounting portions 31*a* formed respectively at both ends thereof. The mounting portions 31*a* are fitted respectively into holes 30*c* and 30*a* formed in side plates of the frame 30, whereby the first interlocking member 31 is mounted rotatably in the interior of the frame 30.

A hole 34 is formed in an end face of each mounting portion 31*a* and a rotary shaft 33 of a variable resistor 32 is press-fitted into one of the holes 34. Further, a slit 35 is formed longitudinally in the arched portion of the first interlocking member 31.

Below the first interlocking member 31 is disposed a second interlocking member 40 in a direction perpendicular to the first interlocking member 31. The second interlocking member 40 is centrally provided with a spherical body 41, and is also provided with right and left arm portions 42 extending horizontally from the spherical body 41, with circular mounting portions 42*a* being projectingly formed respectively at the ends of the arm portions 42. The mounting portions 42*a* are inserted respectively into holes 30*b* and 30*d* formed in the frame 30, whereby the second interlocking member 40 is mounted rotatably in the interior of the frame 30.

A hole 43 is formed in an end face of each mounting portion 42*a* and the rotary shaft 33 of another variable resistor 32 is press-fitted into one of the holes 43.

A slot 45 is vertically formed centrally through the spherical body 41. The first and second interlocking members 31, 40 are disposed in such a manner that the respective slit 35 and slot 45 are aligned with each other perpendicularly.

An operating shaft 36 is inserted through the slot 45 of the second interlocking member 40. The operating shaft 36 takes a shape such that an oval-shaped support portion 38 is formed at the center and upper and lower support rods are projected and integral with the support portion 38. A disc-like spring shoe 47 integral with the operating shaft 36 is formed at a position close to a lower end portion 36*a* of the operating shaft 36 projecting downward.

A small hole 39 is formed in the support portion 38 of the operating shaft 36. The hole 39 is aligned with a hole 44 formed sideways of the second interlocking member 40 and a round pin 46 is inserted or press-fitted into the thus-aligned holes 39 and 44, whereby the operating shaft 36 is mounted tiltably to the second interlocking member 40.

The operating shaft 36 extending upward from the support portion 38 is inserted through the slit 35 of the first interlocking member 36. By tilting the operating shaft 36 along the slit 35 of the first interlocking member 31, the second interlocking member 40 can be rotated with its mounting portions 42*a* as fulcrums. A knob 55 is fixed to the upper end of the operating shaft 36 which extends upward from the slit 35.

An operating member 37, which is formed dish-like in external form from a resin material, is secured to the lower end portion 36*a* of the operating shaft 36. A boss portion 37*a* is centrally projected on the operating member 37 and the end portion 36*a* of the operating shaft 36 is inserted into a bore 50 formed in the boss portion 37*a* so that the operating member 37 can move vertically.

A bottom plate 49 is mounted so as to cover the lower opening of the frame 30. In this state, the operating member 37 is in elastic contact with the bottom plate 49.

By tilting the operating shaft 36 along the slot 45 of the second interlocking member 40 with the round pin 46 as a fulcrum, the first interlocking member 31 can rotate with its mounting portions 31*a* as support shafts. Likewise, by tilting the operating shaft 36 along the slit 35 of the first interlocking member 31, the second interlocking member can rotate with its mounting portions 42*a* as support shafts.

The rotary shafts 33 of the variable resistors 32 locked to side plates of the frame 30 are press-fitted in the holes 34 and 43 of the first and second interlocking members so that both interlocking members and the variable resistors operate integrally with each other.

A generally conical return spring 48 is positioned between the spring shoe 47 of the operating shaft 36 and an inside bottom of the operating member 37. The biasing force of the return spring 48 urges the operating member 37 into elastic contact with the bottom plate 49, whereby the operating shaft 36 can be held in an upright neutral state.

The operation of the conventional multi-way input device will now be described. First, as shown in FIG. 12, the upper end of the operating shaft 36, when not in operation, projects upright from a hole 56 formed in a top plate of the frame 30 and the operating member 37 is kept in elastic contact with the bottom plate 49 in a horizontal state by means of the return spring 48, so that the operating shaft 36 is in an upright neutral state.

As shown in FIG. 13, by tilting the operating shaft 36, for example, clockwise along the slot 45 of the second interlocking member 40, the first interlocking member 31 is rotated, whereby the variable resistor 32 is operated and hence the resistance value thereof can be changed.

As a result of the tilting motion of the operating shaft 36, the operating member 37 tilts as in FIG. 13 and part of the peripheral edge of the thus-tilted operating member 37 moves in sliding contact with the surface of the bottom plate 49. Consequently, the operating member 37 moves toward the circular spring shoe 47, thereby causing the return spring 48 to be compressed and deflected.

Upon release of the operating force applied to the operating shaft 36, the operating member 37 which has been tilted comes to move in sliding contact with the surface of the bottom plate 49 with the biasing force of the return spring 48. The operating member 37 moves horizontally with respect to the bottom plate 49, and in this way, the operating shaft 36 reverts automatically to its upright neutral state as shown in FIG. 12.

For operating the variable resistor 32 engaged with an arm portion 42 of the second interlocking member 40, the operating shaft 36 is tilted along the slit 35 of the first interlocking member 31, whereby the second interlocking member 40 is rotated and this rotation permits operation of the variable resistor 32.

In the above conventional multi-way input device, however, since the return spring 48 is extended between the spring shoe 47 and the inside bottom of the operating member 37 at a position below the round pin 46 which is a tilting fulcrum of the operating shaft 36, the distance from the round pin 46 to the operating member 37 is long. That is, the vertical size of the input device becomes large, thus making it difficult to reduce the thickness of the device.

In addition, since the round pin 46 is used for supporting the operating shaft 36 in the second interlocking member 40, not only are the number of components used increased, but the operation of press-fitting the round pin 46 into the second interlocking member 40 is needed, thus making the assembling process complicated.

SUMMARY OF THE INVENTION

It is an object of the present invention to solve the above-mentioned problems and provide a multi-way input device using a reduced number of parts, superior in assembling efficiency and low in cost.

According to the first arrangement adopted by the present invention for solving the foregoing problems there is provided a multi-way input device comprising a first interlocking member which has a longitudinal slit and which is rotatable; a second interlocking member disposed in a direction orthogonal to the longitudinal direction of the first interlocking member, the second interlocking member having a slot and being rotatable; a frame within which the first and second interlocking members are mounted; an operating shaft inserted through both the slit of the first interlocking member and the slot of the second interlocking member and supported tiltably by the second interlocking member; a plurality of electric components attached to the frame and capable of being operated through the first and second interlocking members by operation of the operating shaft; a return spring which restores the operating shaft to an upright neutral state automatically when the operating shaft is not in operation; an operating member supported movably on a lower end portion of the operating shaft which is positioned in the interior of the frame; and a bottom plate with which the operating member comes into elastic contact under the biasing force of the return spring and which closes the bottom side of the frame, the operating shaft being provided with a cylindrical portion having a receptacle space for receiving the return spring therein, the cylindrical portion being pivotally supported within the slot of the second interlocking member.

According to the second arrangement adopted by the invention for solving the foregoing problems there is provided, in combination with the above first arrangement, a multi-way input device wherein the operating shaft has pivot shaft portions formed on part of an outer wall of its cylindrical portion, and the second interlocking member has engaging portions for engagement with the pivot shaft portions, the engaging portions being formed inside the slot of the second interlocking member, the pivot shaft portions of the operating shaft being brought into engagement with the engaging portions of the second interlocking member to pivotally support the operating shaft in the second interlocking member.

According to the third arrangement adopted by the invention for solving the foregoing problems there is provided, in combination with the above second arrangement, a multi-way input device wherein the pivot shaft portions of the operating shaft are formed in a convex or concave shape and the engaging portions of the second interlocking member are formed in a concave or convex shape engageable with the pivot shaft portions.

According to the fourth arrangement adopted by the invention for solving the foregoing problems there is provided, in combination with the above first arrangement, a multi-way input device wherein the operating member has a base portion whose bottom is dish-like and a boss portion formed at the center of the base portion and projecting toward the interior of the frame, a lower end portion of the operating shaft is inserted into an axial bore formed in the boss portion of the operating member, and the boss portion being fitted movably in the receptacle space of the operating shaft.

According to the fifth arrangement adopted by the invention for solving the foregoing problems there is provided, in combination with the above fourth arrangement, a multi-way input device wherein the return spring received in the receptacle space of the operating shaft is in elastic contact with the boss portion of the operating member.

According to the sixth arrangement adopted by the invention for solving the foregoing problems there is provided, in combination with the above fourth arrangement, a multi-way input device wherein the bottom of the operating member has an external shape larger than the receptacle space of the operating shaft.

DETAILED DESCRIPTION OF A PREFERRED EMBODIMENT

Figure 1:
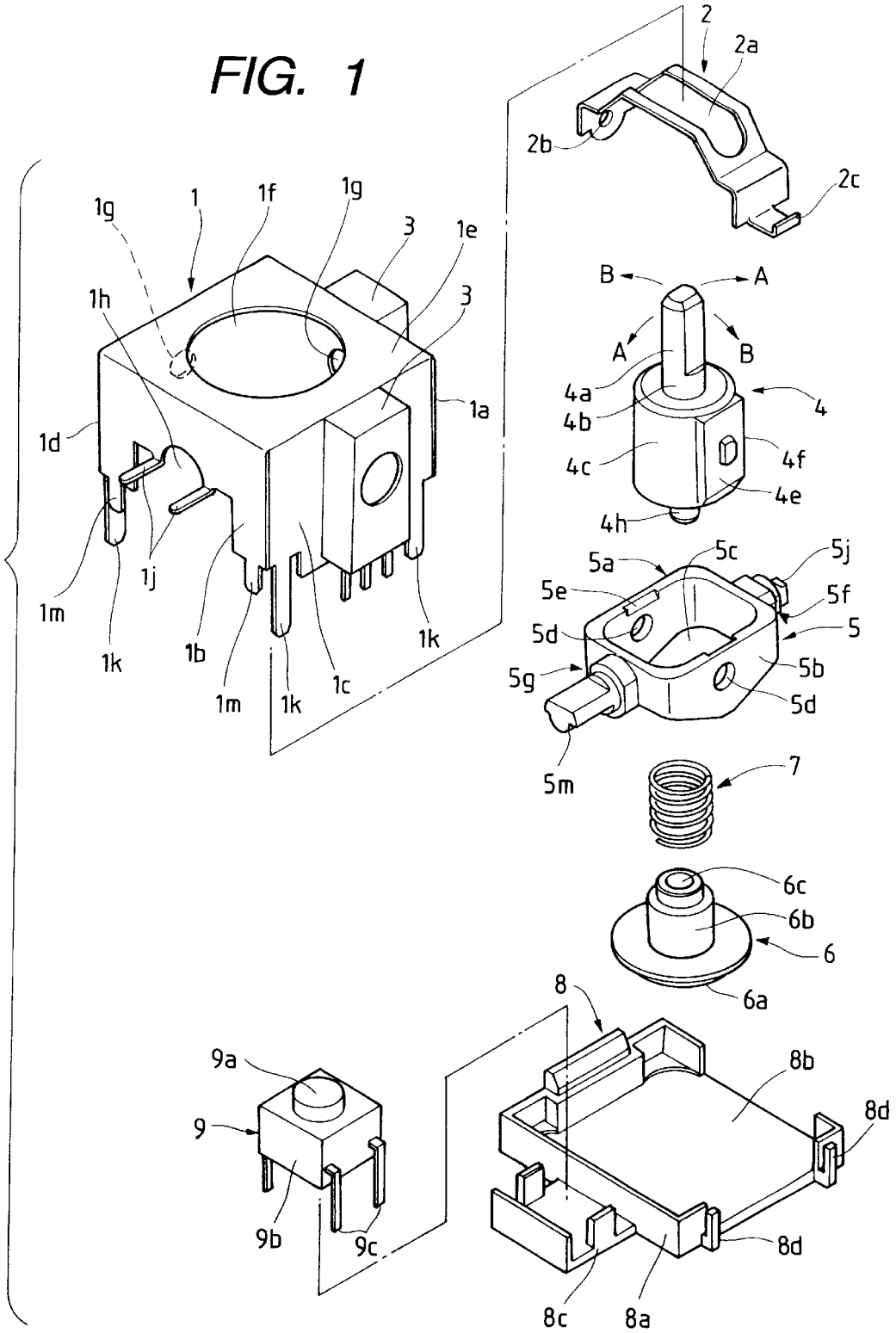
FIG. 1 is an exploded perspective view of a multi-way input device embodying the present invention.
Figure 2:
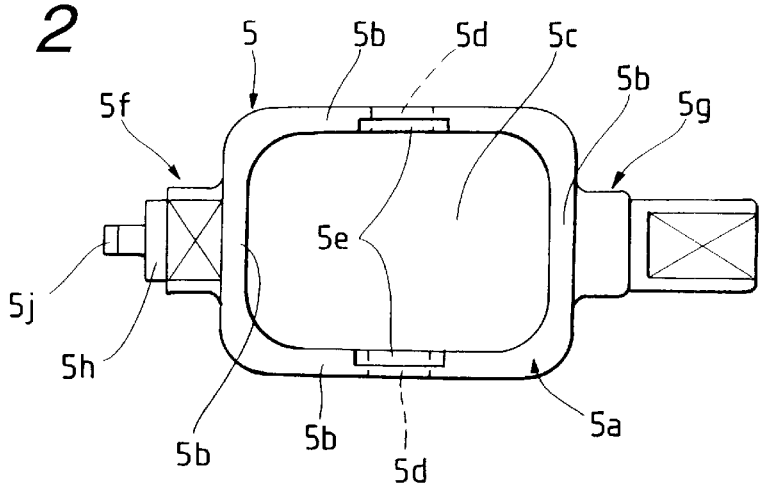
FIG. 2 is a top view of a second interlocking member used in the multi-way input device.
Figure 3:
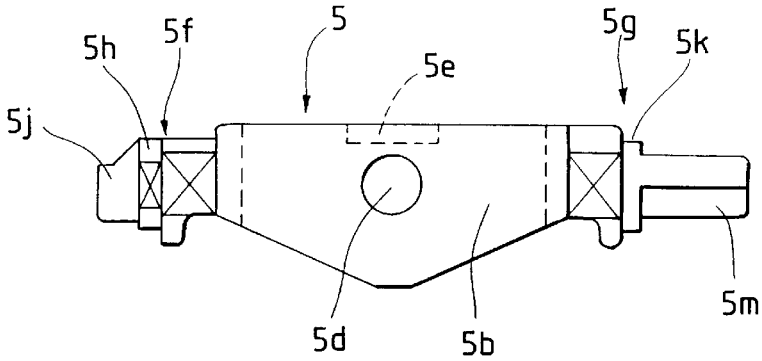
FIG. 3 is a front view of the second interlocking member of FIG. 2.
Figure 4A:
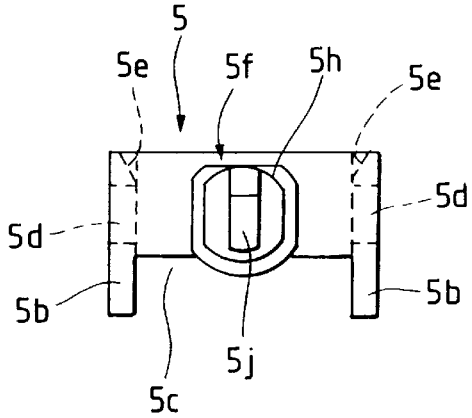
FIGS. 4A and 4B are side views of the second interlocking member of FIG. 2.
Figure 4B:
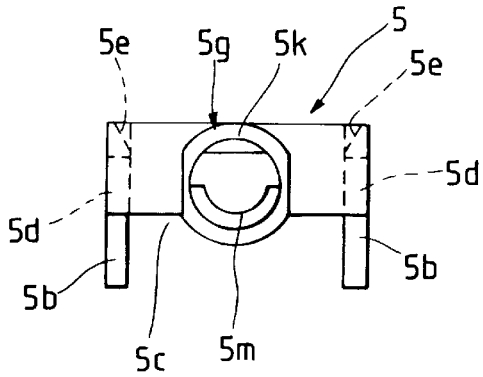
Figure 5:
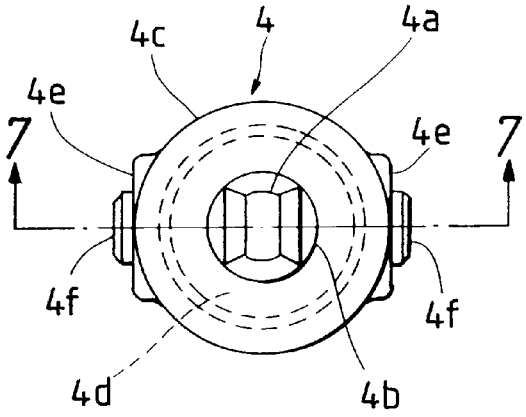
FIG. 5 is a top view of an operating shaft used in the multi-way input device.
Figure 6:
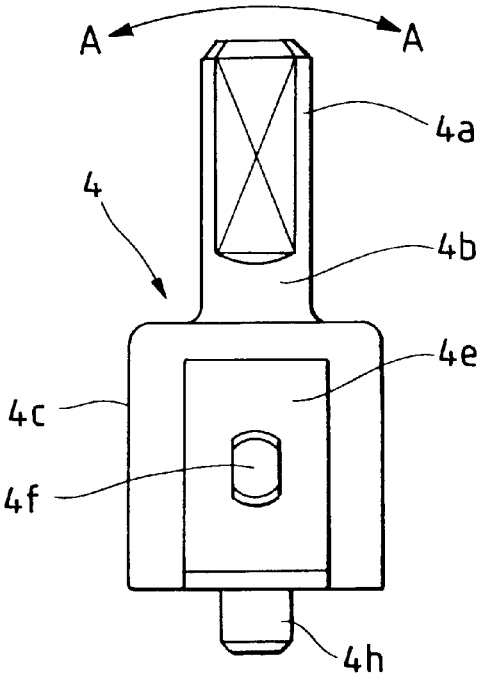
FIG. 6 is a front view of the operating shaft of FIG. 5.
Figure 7:
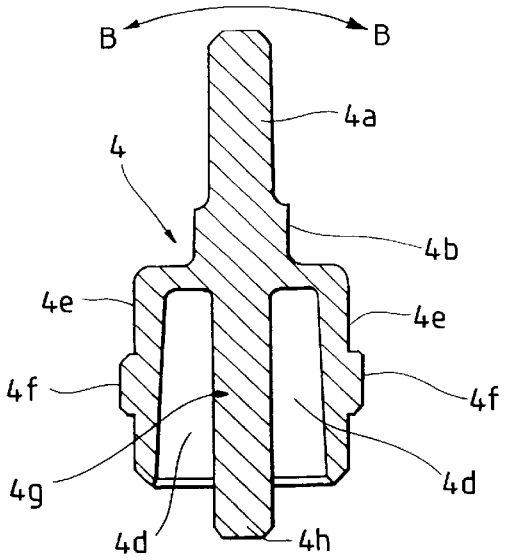
FIG. 7 is a sectional view taken on line 7—7 in FIG. 5.
Figure 8:
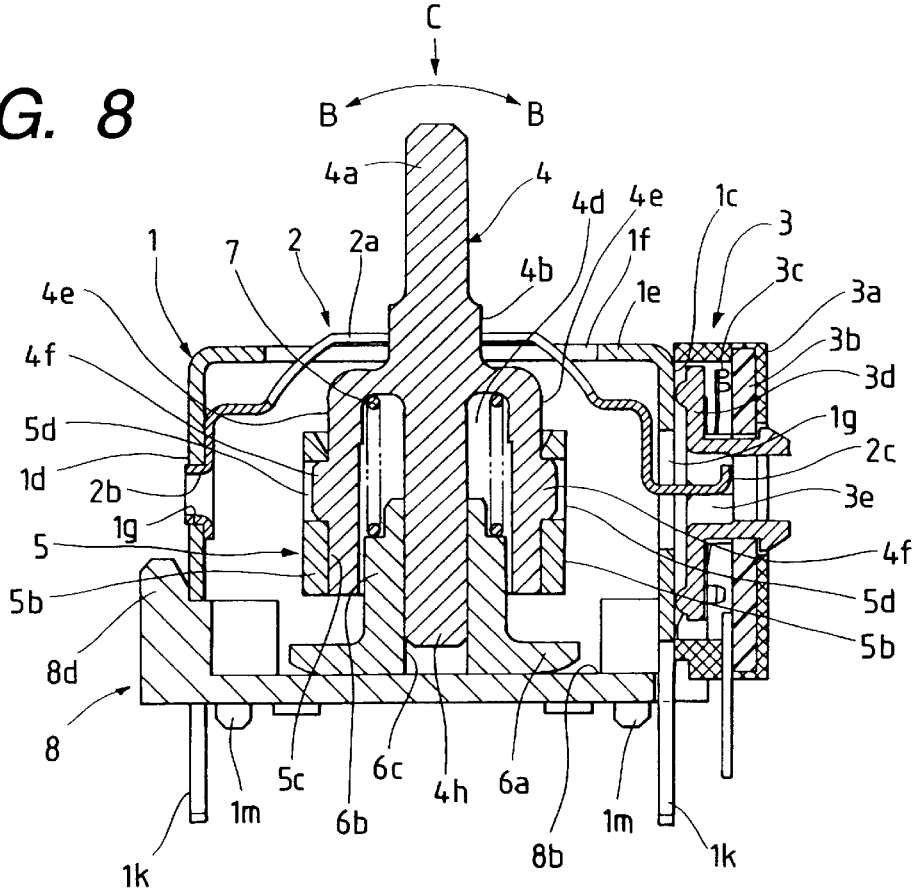
FIG. 8 is a sectional view of a principal portion of the multi-way input device.
Figure 9:
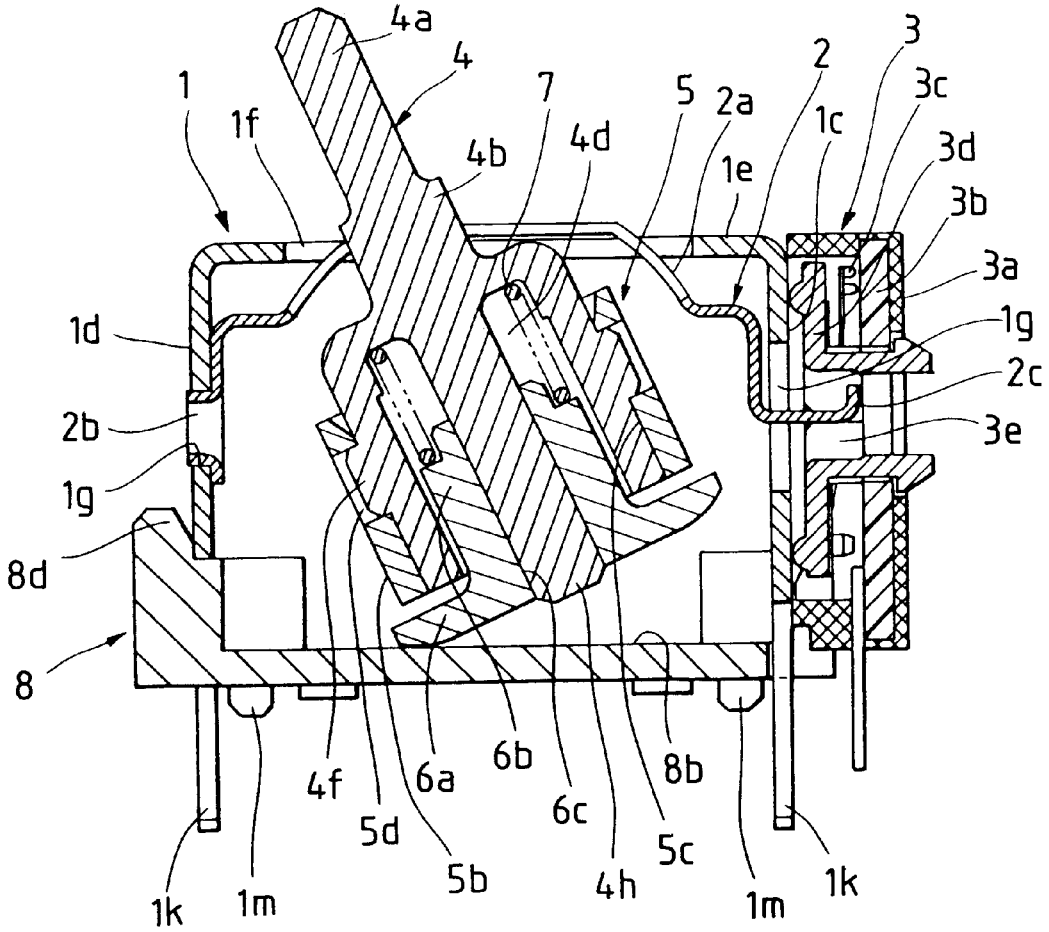
FIG. 9 is a sectional view of the principal portion of the multi-way input device, explaining the operation of the device.
Figure 10:
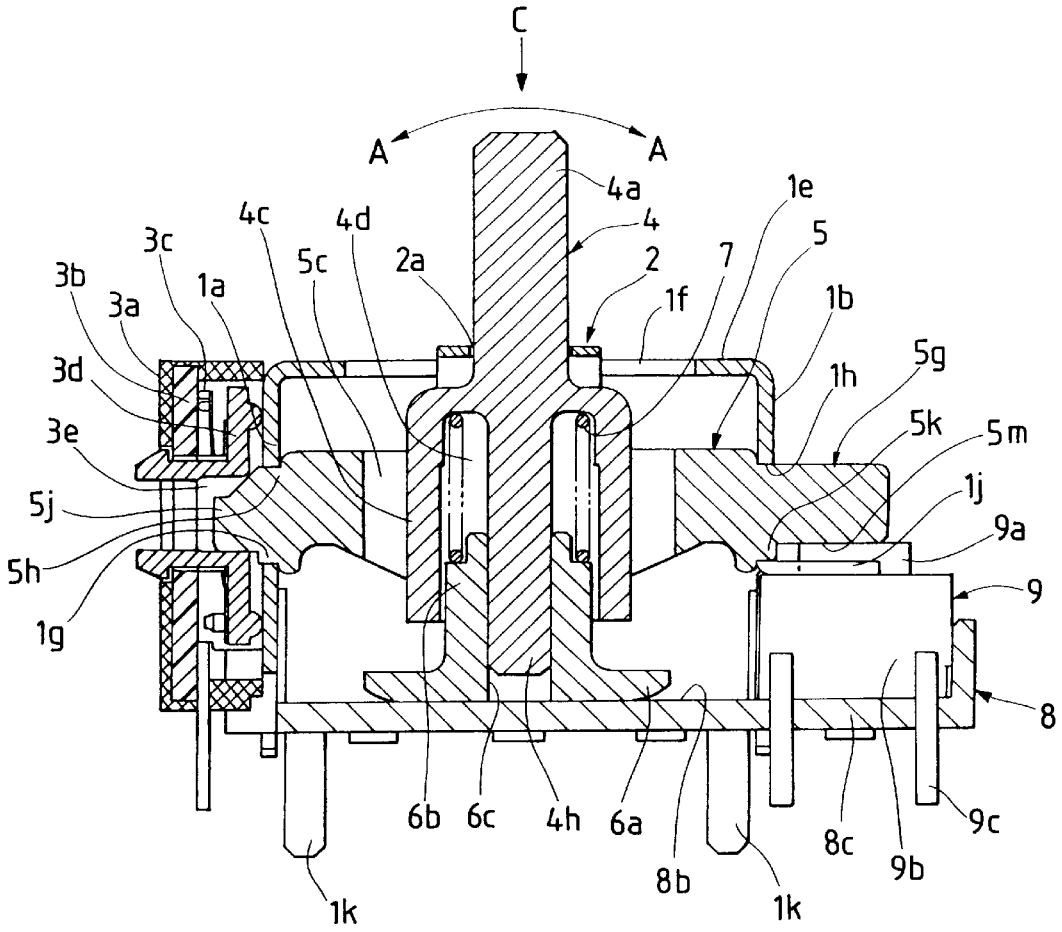
FIG. 10 is a sectional view of a principal portion of the multi-way input device.
Figure 11:
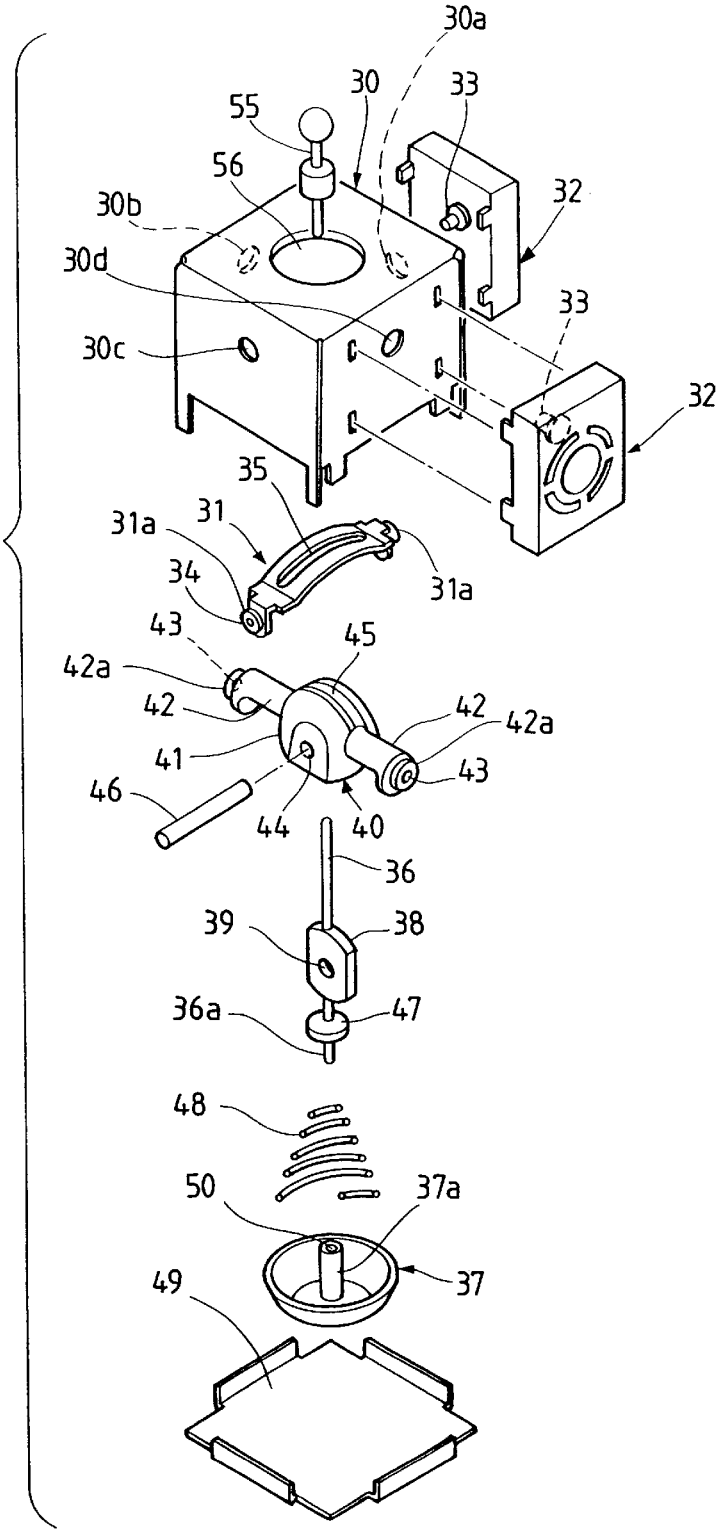
FIG. 11 PRIOR ART
FIG. 11 is a perspective view of a conventional multi-way input device.
Figure 12:
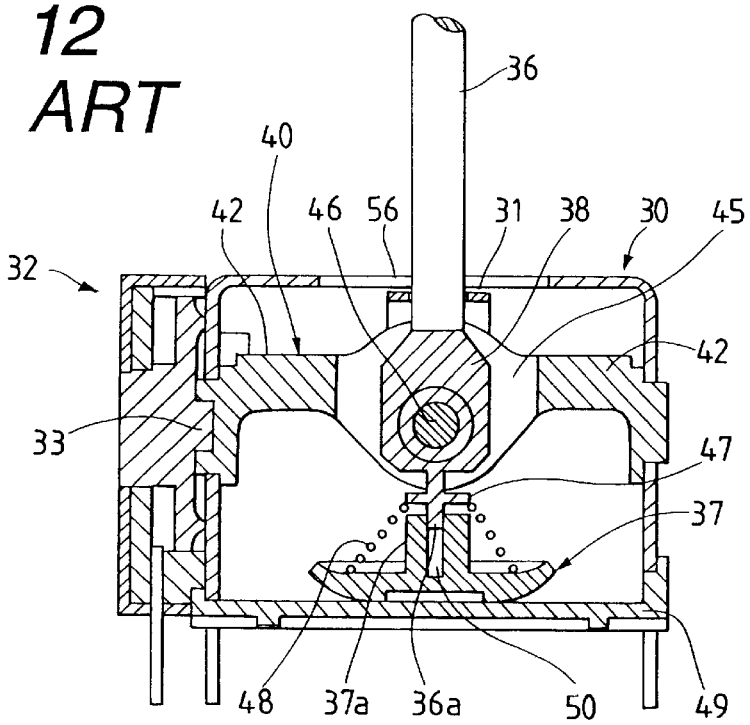
FIG. 12 PRIOR ART
FIG. 12 is a sectional view of a principal portion of the conventional multi-way input device.
Figure 13:
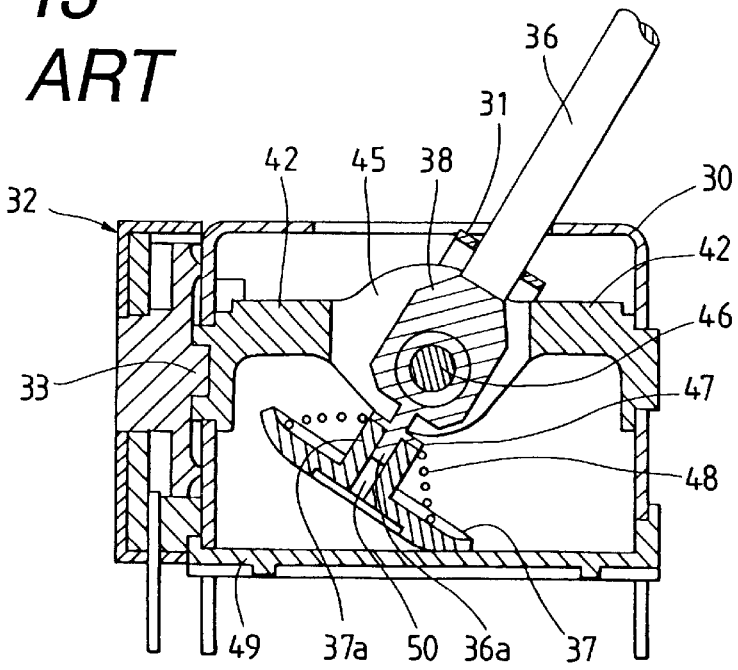
FIG. 13 PRIOR ART
FIG. 13 is a sectional view of the principal portion, explaining the operation of the conventional multi-way input device.

A multi-way input device according to an embodiment of the present invention will be described hereinunder with reference to FIGS. 1 to 10, of which FIG. 1 is an exploded perspective view of the multi-way input device, FIGS. 2 to 4 are diagrams illustrating a second interlocking member used in the multi-way input device, FIGS. 5 to 7 are diagrams illustrating an operating shaft used in the multi-way input device, and FIGS. 8 to 10 are diagrams illustrating the operation of the multi-way input device.

In the multi-way input device, as shown in FIG. 1, a frame 1 is disposed which is formed by an iron plate or the like.

The frame 1 has side plates 1*a*, 1*b*, 1*c* and 1*d* formed by bending, for example, an iron plate downward as shown in the figure by means of a press or the like. The frame 1 has a hollow interior and its bottom is open. Its external form is generally in the shape of a rectangular parallelepiped. The top of the, frame 1 is covered with a top plate 1*e*, with an operating hole 1*f* being formed centrally in the top plate 1*e*.

Circular holes 1*g* are formed respectively in the three side plates 1*a*, 1*c* and 1*d* (other than the side plate 1*b*). A plurality of rectangular apertures (not shown) for mounting variable resistors 3 as electric components, which will be described later, are formed in the side plates 1*a* and 1*c*. In the side plate 1*b* opposed to the side plate 1*a* is formed a support portion 1*h* of a generally semicircular shape at a position opposed to the circular hole 1*g* formed in the side plate 1*a*. On both right and left sides of the support portion 1*h* are formed component holding legs 1*j* which are bent outwards at approximately right angles from the side plate 1*b*.

A plurality of mounting terminals 1*k* for mounting the multi-way input device to a printed circuit board (not shown) are extended downward from the lower ends of the opposed side plates 1*c* and 1*d*.

Two tongue pieces 1*m* for mounting a bottom plate 8, which will be described later, are formed at lower positions of each of the side plates 1*a* and 1*b*.

A first interlocking member 2 formed by, for example, a phosphor bronze plate is disposed within the hollow portion of the frame 1. The first interlocking member 2 is curved upward in an arch shape by means of a press or the like, and a slit 2*a* is formed longitudinally in the arcuate portion by punching.

Both end portions of the first interlocking member 2 are bent downward, and at the thus-bent left-hand end portion in the figure there is formed a projecting pipe-like support portion 2*b*, by drawing for example. The support portion 2*b* is inserted into the circular hole 1*g* of the side plate 1*d*, whereby the first interlocking member 2 is supported rotatably.

The opposite right-hand end portion in the figure of the first interlocking member 2 is bent in a general U shape to form a component operating portion 2*c*. The component operating portion 2*c* is inserted into a circular hole (not shown) formed in the side plate 1*c* of the frame 1 and projects outwards into engagement with a lateral groove formed in the slider receptacle portion 3*d* of a variable resistor 3 to be described later.

The first interlocking member 2 is connected bridgewise to the circular holes formed respectively in the side plates 1*c* and 1*d* of the frame 1, whereby its arcuate portion is mounted rotatably within the frame 1.

For example, two variable resistors 3 as electric components are attached by snap-fitting or any other suitable means to a plurality of rectangular holes (not shown) formed in the side plate 1*a* and the side plate 1*c* adjacent thereto of the frame 1.

Each variable resistor 3 has such a structure as shown in FIG. 8, in which a board 3*b* formed integrally by insert molding, for example, is disposed in the interior of a case 3*a*, the slider receptacle portion 3*d* with a slider piece 3*c* attached air thereto is attached to the board 3*b* rotatably by snap-fitting, for example, and an operating portion 3*e* having engaging grooves comprising vertical and lateral grooves is formed at a rotational center of the slider receptacle portion 3*d*.

The component operating portion 2*c* of the first interlocking member 2 projecting outwards from the circular hole (not shown) formed in the side plate 1*c* of the frame 1 engages the operating portion 3*e* of the variable resistor 3 attached to the side plate 1*c* so that the slider receptacle portion 3*d* of the variable resistor 3 rotates upon rotation of the first interlocking member 2 to change the resistance value of the variable resistor 3.

A knob portion 4*a* of the operating shaft 4 is inserted into the slit 2*a* of the first interlocking member 2. The knob portion 4*a* and a base end portion 4*b* of the operating shaft 4 are movable along the slit 2*a*. The operating shaft 4 is preferably formed of a synthetic resin material. As shown in FIGS. 5 to 7, the knob portion 4*a* is formed in an oval shape and the base end portion 4*b* is formed in a circular shape. A cylindrical portion 4*c* having a hollow interior is integral with the circular base end portion 4*b*.

The cylindrical portion 4*c* is comprised of a peripheral wall and its lower side open. In the interior of the cylindrical portion 4*c* is formed a hollow receptacle space 4*d* for receiving therein a generally coil-shaped return spring 7 to be described later. As shown in FIG. 5, on the outer wall of the cylindrical portion 4*c* are formed two flat portions 4*e* in an opposed relation to each other, and on part of the flat portions 4*e* are respectively formed oval-shaped pivot shaft portions 4*f* convexly at a predetermined diameter and height.

In the interior of the spring receptacle space 4*d* is integrally formed a shaft portion 4*g* coaxially with the knob portion 4*a*. The shaft portion 4*g* extends downward in FIG. 7 so that a lower end 4*h* thereof projects downward to a greater extent than the spring receptacle space 4*d*.

The operating shaft 4 allows its pivot shaft portions 4*f* to be supported by a second interlocking member 5 and can thereby tilt in both arrow A—A and B—B directions as shown in FIG. 1.

The second interlocking member 5, which is formed of a synthetic resin material, is disposed below the first interlocking member 2 in a direction perpendicular to the first interlocking member 2.

As shown in FIG. 2, a support portion 5*a* of a generally rectangular shape is formed nearly centrally of the second interlocking member 5. The support portion 5*a* comprises long and short side walls 5*b* defining an inside space through which is formed an opening or slot 5*c* of a generally rectangular shape.

A pair of engaging portions 5*d* for engagement with the pivot shaft portions 4*f* of the operating shaft 4 are formed respectively in predetermined positions of the long side walls 5*b* of the support portion 5*a*. The engaging portions 5*d* are formed through the side walls or in a concave shape having a predetermined depth. Further, chamfered guide portions 5*e* each of a predetermined size are formed respectively at inner edges of the long side walls 5*b* above the engaging portions 5*d* as in FIG. 3. When the operating shaft 4 is brought into engagement with the second interlocking member 5 by snap-fitting, the chamfered guide portions 5*e* permit the pivot shaft portions 4*f* to be guided smoothly into the engaging portions 5*d*.

As shown in FIG. 3, first and second arm portions 5*f*, 5*g* extend horizontally right and left from the support portion 5*a*. The first arm portion 5*f* extending on one side is formed with a support portion 5*h* of a predetermined diameter, and a plate-like component operating portion 5*j* of a predetermined width projects from the support portion 5*h*.

The second arm portion 5*g* extending on the other side is formed with a support portion 5*k* of a predetermined diameter, and a component operating portion 5*m* having a flat upper surface and a semicircular lower surface extends from the support portion 5*k*.

The support portion 5*h* of the first arm portion 5*f* in the second interlocking member 5 is inserted into the circular hole 1*g* formed in the side plate 1*a* of the frame 1 and is thereby supported rotatably, while the support portion 5*k* of the second arm portion 5*g* is positioned and supported in the semicircular support portion 1*h* of the side plate 1*b*. Thus, the second interlocking member 5 is supported rotatably and its component operating portion 5*m* as one end portion is mounted vertically movably in the interior of the frame 1.

The component operating portion 5*j* of the first arm portion 5*f* is engaged with the vertical groove formed in the operating portion 3*e* of the variable resistor 3 attached to the side plate 1*a*, while the component operating portion 5*m* of the second arm portion 5*g* is positioned on a stem portion 9*a* of an electric component such as a push-button switch 9 attached to a bottom plate 8 (which will be described later).

An operating member 6, which is movable in the axial direction of the operating shaft 4, is disposed at the lower end 4*h* of the operating shaft 4, the operating shaft 4 being pivotally supported by the second interlocking member 5 and positioned in the interior of the frame 1.

The operating member 6 is preferably formed of a resin material and has a base portion 6*a* on its lower side, the base portion 6*a* having a circular external form and having a dish-like curved bottom. Centrally on the base portion 6*a* is formed a cylindrical boss portion 6*b* projecting toward the interior of the frame 1, with an axial bore 6*c* being formed centrally in the boss portion 6*b*.

The lower end 4*h* of the operating shaft 4 is inserted into the axial bore 6*c* of the operating member 6 and the boss portion 6*b* is fitted in the receptacle space 4*d* of the cylindrical portion 4*c* movably.

A return spring 7 constituted by a coiled spring of a predetermined biasing force is disposed between the boss portion 6*b* of the operating member 6 and the cylindrical portion 4*c* of the operating shaft 4. The return spring 7 is disposed in such a manner that its upper and lower ends are in elastic contact respectively with the ceiling surface of the receptacle space 4*d* in the cylindrical portion 4*c* and with the upper surface of the boss portion 6*c* of the operating member 6. The return spring 7 is fitted on the shaft portion 4*g* and one end portion thereof located on the knob portion 4*a* side is guided by the inner wall of the cylindrical portion 4*c*, while the opposite end portion thereof is guided by the outer wall of the boss portion 6*b*, to restrict lateral motions of the return spring.

Below the operating member 6 is disposed a bottom plate 8 with which the operating member 6 is brought into elastic contact by virtue of the return spring 7 and which closes the lower portion of the frame 1. The bottom plate 8 is formed in a generally rectangular external shape using a resin material and it comprises partial side walls 8*a* and a flat inner bottom 8*b* formed inside the side walls 8*a*.

A component mounting portion 8*c* for mounting an electric component such as a push-button switch 9 projects from one side wall 8*a* of the bottom plate 8. On the side walls 8*a* adjacent to the sidewall 8*a* with the component mounting portion 8*c* formed thereon there are formed projectingly a plurality of guide portions 8*d* for positioning the lower ends of the side plates 1*c* and 1*d* of the frame 1.

The push-button switch 9 attached to the component mounting portion 8*c* comprises a stem portion 9*a* which can turn an internal circuit (not shown) ON and OFF, a case 9*b* which encloses the internal switch circuit therein in a hermetically sealed state, and a plurality of mounting terminals 9*c* extending downward from side faces of the case 9*b*. The mounting terminals 9*c* of the push-button switch 9 can be temporarily fixed to the component mounting portion 8*c* of the bottom plate 8 by snap-fitting for example.

In assembling the multi-way input device constructed as above, the first interlocking member 2 of an arcuate shape is inserted into the frame 1 from the lower open side of the frame and its component operating portion 2*c* is inserted into a circular hole (not shown) formed in the side wall 1*c*, while its support portion 2*b* is inserted into the circular hole 1*g* formed in the side plate 1*d*. In this way the first interlocking member 2 is mounted in the interior of the frame 1.

Next, the cylindrical portion 4*c* of the operating shaft 4 is inserted into the slot 5*c* of the second interlocking member 5 until the convex pivot shaft portions 4*f* are positioned on the chamfered guide portions 5*e* of sidewalls 5*b*. In this state, the operating shaft 4 is pushed down in the slot 5*c* with use of a jig (not shown) or the like, whereby the side walls 5*b* are deformed elastically and expanded outwards and hence the convex pivot shaft portions 4*f* are brought into engagement by snap-fitting with the concave engaging portions 5*d* of the side walls 5*b*. In this way the cylindrical portion 4*c* of the operating shaft 4 is pivotally supported within the slot 5*c* of the second interlocking member 5.

Thus, the flat portions 4*e* as outer walls of the cylindrical portion 4*c* of the operating shaft 4 are held within the slot 5*c* of the second interlocking member 5, allowing the operating shaft 4 to be supported by the second interlocking member 5.

Next, grease is applied into spaces formed by both-side linear portions in the oval shape of each pivot shaft portion 4*f* and the circular engaging portion 5*d* to prevent the occurrence of creak or any other inconvenience between the operating shaft 4 and the second interlocking member 5.

Then, the knob portion 4*a* of the operating shaft 4 thus supported by the second interlocking member 5 is inserted through the slit 2*a* of the first interlocking member 2 and is projected outwards from the operating hole 1*f* of the frame 1, allowing its circular base end portion 4*b* to be positioned in the slit 2*a*.

Further, the support portion 5*h* of the first arm portion 5*f* in the second interlocking member 5 is inserted into the circular hole 1*g* of the side plate 1*a*, allowing the component operating portion 5*j* formed as a tip portion to be projected outwards from the side plate la, and the support portion 5*k* of the second arm portion 5*g* is positioned in the support portion 1*h* of the side plate 1*b* of the frame 1.

Next, the frame 1 with the first and second interlocking members 2, 5 thus mounted therein is turned upside down, allowing the lower opening to face upward. The return spring 7 is then fitted on the lower end 4*h* of the thus inverted operating shaft 4 and is received in the receptacle space 4*d* of the cylindrical portion 4*c*.

Then, the axial bore 6*c* of the operating member 6 is fitted on the lower end 4*h* of the operating shaft 4, whereby the boss portion 6*b* of the operating member 6 is fitted movably into the cylindrical portion 4*c* of the operating shaft 4 and the operating member 6 comes into elastic contact with the return spring 7.

The bottom plate 8 with the push-button switch 9 secured temporarily to the component mounting portion 8*c* is inverted and attached to the inverted frame 1. At this time, end portions of the side plate 1*c* are guided by the guide portions 8*d* and the frame 1 is thereby positioned on the bottom plate 8. At the same time, the component holding legs 1*j* of the side plate 1*b* are positioned on the upper surface of the case 9*b* of the push-button switch 9 and the push-button switch is fixed to the bottom plate 8.

The plural tongue pieces 1*m* extending downward from the side plates 1*a* and 1*b* of the frame 1 are caulked, thereby rendering the bottom plate 8 integral with the frame 1. The operating member 6 comes into elastic contact with the bottom plate 8, and the operating shaft 4 assumes its upright neutral state, as shown in FIG. 8.

Next, the operating portion 3*e* of one variable resistor 3 is brought into engagement with the component operating portion 5*j* of the second interlocking member 5 projecting outwards from the side plate 1*a* and the variable resistor 3 is engaged by snap-fitting with a plurality of rectangular holes (not shown) formed in the side plate 1*a*.

Likewise, the operating portion 3*e* of the other variable resistor 3 is brought into engagement with the component operating portion 2*c* of the first interlocking member 2 projecting outwards from the side plate 1*c* and the variable resistor 3 is secured to the side plate 1*c*. This completes the assembling work for the multi-way input device.

Although in the assembling work described above the electric components, i.e., the variable resistors 3, are secured to the frame 1 after mounting the first and second interlocking members 2, 5 to the frame 1, the variable resistors 3 may be mounted before mounting the first and second interlocking members 2, 5 to the frame 1.

The operation of the multi-way input device will now be described. First, when any operating force is not applied to the knob portion 4*a* of the operating shaft 4, that is, with no load applied, the operating member 6 is brought into elastic contact with the inner bottom 8*b* of the bottom plate 8 under the biasing force of the return spring 7 and the dish-like bottom of the base portion 6*a* of the operating member 6 assumes a horizontal state, while the operating shaft assumes its upright neutral state.

When an operating force acting in an arrow B direction is applied to the knob portion 4*a* of the operating shaft 4, the operating shaft 4 tilts and, the second interlocking member 5 turns with the support portions 5*h* and 5*k* of the first and second arm portions 5*f*, 5*g* respectively as fulcrums. Further, as shown in FIG. 9, the bottom of the base portion 6*a* of the operating member 6 moves in sliding contact with the upper surface of the inner bottom 8*b* of the bottom plate 8 and the operating member 6 tilts while part of the outer periphery of the bottom of the base portion 6*a* is positioned on the inner bottom 8*b* of the bottom plate.

The boss portion 6*b* of the operating member 6 is pushed into the receptacle portion 4*d* of the cylindrical portion 4*c* of the operating shaft 4 against the biasing, force of the return spring 7.

When the operating shaft 4 is tilted to rotate the second interlocking member 5, the slider receptacle portion 3*d* of the variable resistor 3 attached to the side plate 1*a* with which the component operating portion 5*j* of the first arm portion 5*f* is engaged, rotates and the resistance value of the variable resistor 3 changes.

When the operation of the variable resistor 3 attached to the side plate 1*a* is over and the operating force which has been exerted on the operating shaft 4 is relieved, the operating member 6 reverts to its horizontal state automatically because of the biasing force of the return spring 7 and the operating shaft 4 reverts to its upright neutral state automatically.

When an operating force acting in an arrow A direction is applied to the operating shaft 4 to tilt the same shaft, the first interlocking member 2 rotates with both support portion 2*b* and component operating portion 2*c* as fulcrums.

Upon rotation of the first interlocking member 2, the slider receptacle portion 3*d* of the variable resistor 3, which is attached to the side plate 1*c* and with which the component operating portion 2*c* is engaged, rotates and the resistance value of the variable resistor 3 changes.

For operating the push-button switch 9, a downward load is applied in an arrow C direction to the operating shaft 4, as shown in FIG. 10, to push the operating shaft.

As a result, the second arm portion 5*g* moves downward with the support portion 5*h* of the first arm portion 5*f* of the second interlocking member 5 as a fulcrum which member 5 is inserted into the circular hole 1*g* formed in the side plate 1*a* of the frame 1. With this movement of the second arm portion 5*g*, the component operating portion 5*m* at one end portion of the second interlocking member 5, which portion 5*m* projects outward from the semicircular support portion 1*h* of the frame side plate 1*b*, moves vertically and pushes the stem portion 9*a* of the push-button switch 9. In this way the push-button switch 9 can be turned ON and OFF.

The operating shaft 4 can be pushed in an arrow C direction not only when the operating shaft is in its neutral state but also after tilting of the operating shaft and after attainment of a predetermined resistance value of the variable resistor Although in the above embodiment the pivot shaft portions 4*f* formed on part of the outer wall of the cylindrical portion 4*c* of the operating shaft 4 are brought into engagement with the engaging portions 5*d* formed in side walls of the second interlocking member 5, the operating member 4 alternatively may be pivotally supported through, for example, a round pin (not shown) in the second interlocking member 5.

Thus, in the multi-way input device of the present invention, no special limitation is placed on the shape of the pivot shaft portions 4*f* or the engaging portions 5*d* insofar as the cylindrical portion 4*c* of the operating shaft 4 being pivotally supported within the slot 5*c* of the second interlocking member 5.

Although in the above embodiment the pivot shaft portions 4*f* on the operating shaft 4 side are formed in a convex shape and the engaging portions 5*d* of the second interlocking member 5 are formed in a concave shape, the former may be formed concavely and the latter convexly.

Although in the above embodiment the variable resistors 3 and the push-button switch 9 were used as plural electric components, any other electric components may be used if they can be rotated or pushed.

Although in the above embodiment the cylindrical portion 4*c* of the operating shaft 4 has a peripheral wall as an enclosure, the portions where the pivot shaft portions 4*f* are formed may be open. In this case, in the assembling work involving engaging the pivot shaft portions 4*f* by snap-fitting with the engaging portions 5*d* of the second interlocking member 5, the pivot shaft portions 4*f* become easier to undergo elastic deformations and therefore the snap-fitting can be done more smoothly.

Although in the above embodiment the operating shaft 4 and the bottom plate 8 are formed using a synthetic resin, they may be formed using a metallic material such as a die casting alloy to provide sufficient strength and prevent chipping.

Although in the above embodiment there is no tilt stopper on the knob portion 4*a* side during the tilting motion of the operating shaft 4, there may be adopted a modification such that a portion formed by drawing (not shown), such as an inverted bowl, which covers part of the slit 2*a* of the first interlocking member 2 from above, is provided at the center of the top plate 1*e* of the frame 1, and an aperture (not shown) against which the base end portion 4*b* of the knob portion 4*a* comes into abutment during the tilting motion of the operating shaft 4 is formed centrally of the inverted bowl-like drawn portion and is allowed to function as a tilt stopper for the operating shaft 4.

In the multi-way input device of the present invention, as set forth above, since the operating shaft is provided with a cylindrical portion having a return spring receptacle space and the cylindrical portion is pivotably supported within the slot of the second interlocking member, it becomes possible to dispose the return spring in the vicinity of the pivotally supported positions of the cylindrical portion and therefore it becomes possible for the multi-way input device to be reduced in thickness.

According to the second arrangement adopted by the invention, the operating shaft has pivot shaft portions formed on part of an outer wall of its cylindrical portion, and the second interlocking member has engaging portions for engagement with the pivot shaft portions of the operating shaft, the engaging portions being formed in side walls of the second interlocking member which define the slot, the pivot shaft portions of the operating shaft being brought into engagement with the engaging portions of the second interlocking member to pivotally support the operating shaft in the second interlocking member. According to this construction, the pivot shaft portions formed on the outer wall of the cylindrical portion of the operating shaft can be brought into engagement by snap-fitting with the engaging portions of the second interlocking member and it is not necessary to use any special part such as a round pin for supporting the operating shaft and the second interlocking member. Thus, the multi-way input device is not only superior in the assembling work efficiency but also is reduced in the number of parts used and in cost.

According to the third arrangement adopted by the invention, the pivot shaft portions of the operating shaft are formed in a convex or concave shape and the engaging portions of the second interlocking member for engagement with the pivot shaft portions of the second interlocking member are formed in a concave or convex shape, so through the engagement of the pivot shaft portions and the engaging portions, that is, through convex-concave engagement, the operating shaft can be surely engaged by snap-fitting with the second interlocking member and can thereby be prevented from coming off the second interlocking member.

According to the fourth arrangement adopted by the invention, the operating member has a base portion whose bottom is dish-like and a boss portion formed at the center of the base portion and projecting toward the interior of the frame, the lower end portion of the operating shaft is inserted into an axial bore formed in the boss portion, and the boss portion being fitted movably in the receptacle space of the operating shaft. Therefore, even when the operating shaft is tilted, the boss portion of the operating member can be moved smoothly within the receptacle space of the operating shaft and thus the multi-way input device affords a good operation feeling of the operating shaft.

According to the fifth arrangement adopted by the invention, since the return spring received in the receptacle space of the operating shaft is brought into elastic contact with the boss portion of the operating member, the operating member can be moved more smoothly within the receptacle space. In addition, since the return spring is received in the receptacle space, a lateral movement of the return spring can be diminished and its biasing force can be more positively transmitted to the operating member. Consequently, upon release of the operating force exerted on the operating shaft, the operating shaft can be restored to its upright neutral position quickly and reliably.

Further, since the bottom of the operating member has an external shape larger than the receptacle space of the operating shaft, the amount of the axial movement of the operating member can be increased when the operating shaft is tilted, thus making it possible to increase the amount of compression of the return spring. As a result, a large biasing force can be applied to the operating member, and the operating shaft, upon release of the operating force exerted thereon, can be restored to its upright neutral state rapidly and positively.

What is claimed is:

1. A multi-way input device comprising:

a first interlocking member having a longitudinal slit and being rotatably mounted;

a second interlocking member disposed in a direction orthogonal to a longitudinal direction of said first interlocking member, said second interlocking member having a slot and being rotatably mounted;

a frame within which said first and second interlocking members are mounted;

an operating shaft inserted through both said slit of the first interlocking member and said slot of the second interlocking member and supported tiltably by the second interlocking member, said operating shaft having a centrally located shaft portion;

a plurality of electric components attached to said frame and operated through said first and second interlocking members by operation of said operating shaft;

a return spring which restores said operating shaft to an upright neutral state automatically when the operating shaft is not in operation;

an operating member supported movably on a lower end of the shaft portion of said operating shaft; and a bottom plate which said operating member comes into elastic contact under the biasing force of said return spring and which closes the bottom side of said frame, said operating shaft being provided with a cylindrical portion having a tubular wall that is spaced apart from the shaft portion so as to form a receptacle space between the shaft portion and an interior face of the tubular wall for receiving said return spring therein, wherein the tubular wall of said cylindrical portion is provided with a pivotally supported portion that is pivotally supported by the second interlocking member, said pivotally supported portion and said return spring being disposed so as to overlap with each other along an axial direction of the shaft portion.

2. A multi-way input device according to claim 1, wherein said operating shaft has pivot shaft portions formed on an outer face of the tubular wall of said cylindrical portion, and said second interlocking member has engaging portions for engagement with said pivot shaft portions, said engaging portions being formed on an interior wall of the second interlocking member, said pivot shaft portions of the operating shaft being brought into engagement with said engaging portions of the second interlocking member to pivotally support the operating shaft in the second interlocking member.

3. A multi-way input device according to claim 2, wherein said pivot shaft portions of said operating shaft are formed in a convex shape and said engaging portions of said interlocking member are formed in a concave shape, said concave shape of the engaging portions being engageable by snap-fitting with the convex shape of said pivot shaft portions.

4. A multi-way input device according to claim 1, wherein said operating member has a base portion with a dish-like shaped bottom and a boss portion formed at a center of said base portion and projecting toward the interior of said frame, the lower end of the shaft portion of said operating shaft being inserted into an axial bore formed in said boss portion of the operating member, and said boss portion being movably inserted into said receptacle space of the operating shaft.

5. A multi-way input device according to claim 4, wherein said return spring received in said receptacle space of said operating shaft is in elastic contact with said boss portion of said operating member.

6. A multi-way input device according to claim 4, wherein the bottom of said operating member has an external shape larger than said receptacle space of said operating shaft.

7. A multi-way input device according to claim 2, wherein said pivot shaft portions of said operating shaft are formed in a concave shape and said engaging portions of said interlocking member are formed in a convex shape, said convex shape of the engaging portions being engageable by snap-fitting with the concave shape of said pivot shaft portions.

8. A multi-way input device according to claim 5, wherein said boss portion comprises a step portion along an outside upper surface thereof, said return spring being fitted on said step portion.

9. A multi-way input device comprising:

a frame defining an interior and an open bottom:

a first interlocking member having a longitudinal slit and being rotatably mounted in said frame;

a second interlocking member disposed orthogonal to said first interlocking member, said second interlocking member having a slot and being rotatably mounted in said frame;

an operating shaft comprising a centrally located shaft portion and a cylindrical portion, said cylindrical portion having a tubular wall that is spaced apart from the shaft portion so as to form a receptacle space between the shaft portion and an interior face of the tubular wall, said operating shaft being inserted through the slit of the first interlocking member and the slot of the second interlocking member, said operating shaft being pivotally supported by engaging portions on interior walls of the second interlocking member, said engaging portions being engaged by shaft portions affixed to an exterior face of the tubular wall;

a plurality of electric components attached to said frame and operated through said first and second interlocking members by a tilting force applied to said operating shaft;

an operating member movably supported on a lower end of the shaft portion of said operating shaft, said operating member having a dish-like shaped bottom and a boss portion formed at a center thereof, said boss portion projecting toward the interior of said frame and movably inserted into the receptacle space of the operating shaft, the lower end of the shaft portion of the operating shaft being inserted into an axial bore formed in said boss portion of the operating member;

a return spring for restoring said operating shaft to an upright neutral state automatically when the tilting force is not applied to the operating shaft, said return spring being disposed within said receptacle space so as to apply a biasing force against said operating shaft and said operating member, said operating member being biased away from said operating shaft; and a bottom plate that encloses the bottom of said frame and against which said operating member comes into elastic contact under the biasing force of said return spring.

* * * * *

UNITED STATES PATENT AND TRADEMARK OFFICE

CERTIFICATE OF CORRECTION

PATENT NO. : 6,445,377 B1
DATED : September 3, 2002
INVENTOR(S) : Hisato Shimomura It is certified that error appears in the above-identified patent and that said Letters Patent is hereby corrected as shown below:

Title page,
Item [57], ABSTRACT,
Line 2, delete "potion" and substitute -- portion -- in its place.

Signed and Sealed this

Eleventh Day of March, 2003

JAMES E. ROGAN
*Director of the United States Patent and Trademark Office*